US008666274B2

(12) United States Patent
Mizutani

(10) Patent No.: US 8,666,274 B2
(45) Date of Patent: Mar. 4, 2014

(54) IMAGE FORMING APPARATUS AND COOLING DUCT

(75) Inventor: Naoki Mizutani, Osaka (JP)

(73) Assignee: Kyocera Document Solutions Inc., Tokyo (JP)

( * ) Notice: Subject to any disclaimer, the term of this patent is extended or adjusted under 35 U.S.C. 154(b) by 296 days.

(21) Appl. No.: 13/074,787

(22) Filed: Mar. 29, 2011

(65) Prior Publication Data

US 2011/0243595 A1 Oct. 6, 2011

(30) Foreign Application Priority Data

Mar. 31, 2010 (JP) ..... 2010-081146

(51) Int. Cl.
*G03G 21/20* (2006.01)

(52) U.S. Cl.
USPC ..... 399/92

(58) Field of Classification Search
USPC ..... 399/92, 94, 96, 107
See application file for complete search history.

(56) References Cited

U.S. PATENT DOCUMENTS

| | | | | |
|---|---|---|---|---|
| 6,308,024 | B1 * | 10/2001 | Nakayama et al. | 399/92 X |
| 2004/0175202 | A1 * | 9/2004 | Fujita | 399/92 |
| 2006/0120747 | A1 * | 6/2006 | Hachisuga | 399/92 |
| 2010/0014885 | A1 * | 1/2010 | Domhoff et al. | 399/92 |
| 2011/0026963 | A1 * | 2/2011 | Kondo | 399/92 |

FOREIGN PATENT DOCUMENTS

| | | | |
|---|---|---|---|
| JP | 07-20753 A | | 1/1995 |
| JP | H 10-115958 | | 5/1998 |
| JP | 2003-255788 A | * | 9/2003 |
| JP | 2006-195357 | | 7/2006 |
| JP | 2007-140277 A | | 6/2007 |
| JP | 2008-216709 A | | 9/2008 |

OTHER PUBLICATIONS

Machine translation of JP 2007-140277 (Isozaki, published Jun. 7, 2007) dated Jul. 5, 2013.*
Notice of Reasons for Rejection issued to JP Application No. 2010-081146, mailed May 23, 2012.

* cited by examiner

*Primary Examiner* — Sophia S Chen
(74) *Attorney, Agent, or Firm* — Knobbe Martens Olson & Bear LLP

(57) ABSTRACT

An image forming apparatus is provided that can achieve a reduction in size while ensuring the necessary cooling performance. The image forming apparatus includes in an apparatus main body thereof: an image carrier; a developing device disposed to oppose the image carrier; a cooling fan; and a cooling duct flowing cool air from the cooling fan to at least the image carrier and the developing device, in which the cooling duct includes an image-carrier cooling duct that flows cool air to the image carrier; and a developing-device cooling duct that flows cool air to the developing device, and the image-carrier cooling duct and the developing-device cooling duct are disposed abreast front to back inside of the apparatus main body.

6 Claims, 4 Drawing Sheets

IMAGE FORMING APPARATUS AND COOLING DUCT

This application is based on and claims the benefit of priority from Japanese Patent Application No. 2010-081146, filed on 31 Mar. 2010, the content of which is incorporated herein by reference.

BACKGROUND OF THE INVENTION

1. Field of the Invention

The present invention relates to an image forming apparatus that flows cool air from cooling fans toward image carriers and developing devices from cooling ducts to cool these image carriers and developing devices, and relates to a cooling duct provided to this image forming apparatus.

2. Related Art

In image forming devices such photocopying machines and printers that form images on paper by xerography, an electrostatic latent image corresponding to image information is first formed on an image carrier such as a photoreceptor drum. Then, this electrostatic latent image is developed using toner, which is a developer, by a developing device, and is visualized as a toner image. Afterwards, the toner image thus formed on the image carrier is transferred onto paper supplied at an appropriate timing. Subsequently, the toner image thus transferred to the paper is fused to the paper by a fusing device using heat and pressure. The paper onto which the toner image has been fused is discharged outside of the image forming apparatus. The sequence of image forming operations is thereby completed.

However, in image forming apparatuses equipped with motors and a fusing device, which are heat sources, inside of the apparatus main body, the temperature inside of the apparatus main body rises due to the image forming operations being repeated, and thus there is a possibility that fusing of toner will occur at the image carrier, developing device, and the like. As a result, cooling fans and cooling ducts have been disposed inside of the apparatus main body, and these image carriers and developing devices have been cooled by flowing cool air from the cooling fans toward the image carriers and developing devices via the cooling ducts.

SUMMARY OF THE INVENTION

Incidentally, in a color image forming apparatus equipped with a plurality of image forming units corresponding to each of a plurality of colors, a configuration has been adopted in which a cooling fan and a cooling duct are disposed at every image forming unit. As a result, space has been required for disposing a plurality of fans and a plurality of cooling ducts inside of the apparatus main body. Due to this, there has been a problem in that the width and height of the apparatus main body becomes large and the image forming apparatus increases in size.

The present invention has been made taking the above-mentioned problem into account, and an object thereof is to provide an image forming apparatus that can achieve a reduction in size while ensuring the necessary cooling performance.

In order to achieve the above-mentioned object, an image forming apparatus according to a first aspect of the invention includes in an apparatus main body thereof: an image carrier; a developing device disposed to oppose the image carrier; a cooling fan; and a cooling duct flowing cool air from the cooling fan to at least the image carrier and the developing device, in which the cooling duct includes an image-carrier cooling duct that flows cool air to the image carrier; and a developing-device cooling duct that flows cool air to the developing device, and the image-carrier cooling duct and the developing-device cooling duct are disposed abreast front to back inside of the apparatus main body.

According to the present invention, the cooling ducts are configured by an image-carrier cooling duct and a developing-device cooling duct, and this image-carrier cooling duct and developing-device cooling duct are disposed at the front and back inside of the apparatus main body. As a result of flowing cool air to the image carriers and the developing devices from the image-carrier cooling duct and the developing-device cooling duct, it is possible to cool each of these image carriers and developing devices, as well as being able to achieve a reduction in the size of the image forming apparatus by reducing the width and height of the apparatus main body.

DETAILED DESCRIPTION OF THE INVENTION

Figure 1:
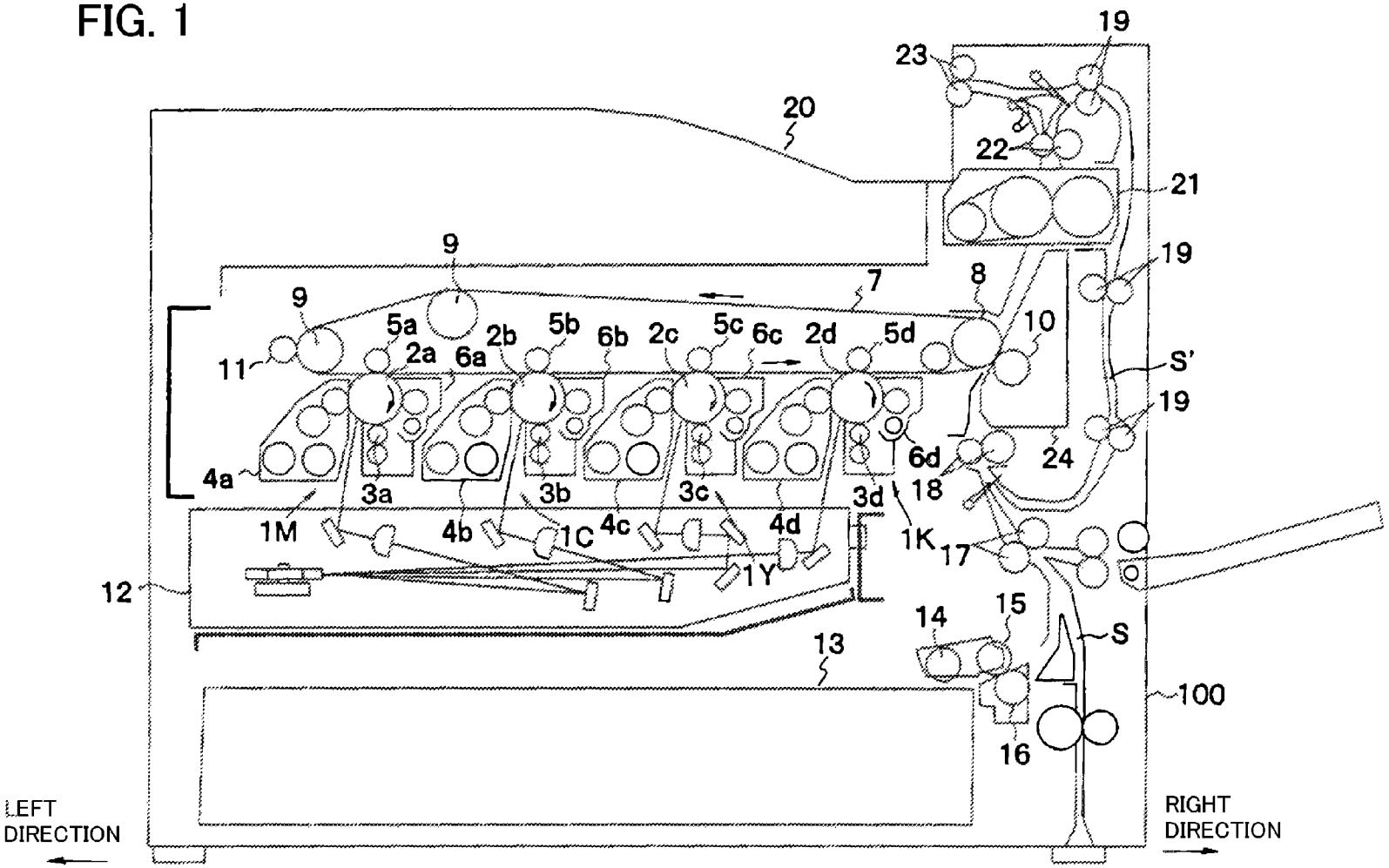
FIG. 1 is a sectional side view of an image forming apparatus (color laser printer) according to the present invention.

Hereinafter, an embodiment of the present invention will be explained while referring to the drawings.

FIG. 1 is a cross-sectional view of a color laser printer as one embodiment of the image forming apparatus according to the present invention. The color laser printer shown in FIG. 1 is of tandem type. A magenta image forming unit 1M, cyan image forming unit 1C, yellow image forming unit 1Y, and black image forming unit 1K are disposed in tandem at predetermined intervals in a center portion inside of an apparatus main body 100 of this color laser printer.

Photoreceptor drums 2*a*, 2*b*, 2*c* and 2*d*, which are image carriers, are respectively disposed in each of the above-mentioned image forming units 1M, 1C, 1Y and 1K. Furthermore, charge rollers 3*a*, 3*b*, 3*c* and 3*d*; developing devices 4*a*, 4*b*, 4*c* and 4*d*; primary transfer rollers 5*a*, 5*b*, 5*c* and 5*d*; and drum cleaning devices 6*a*, 6*b*, 6*c* and 6*d* are respectively disposed at the circumference of each of the photoreceptor drums 2*a* to 2*d*.

Herein, the photoreceptor drums 2*a* to 2*d* are photoreceptors of drum shape, and are rotationally driven at a predetermined process speed in the arrow direction (clockwise direction) shown in FIG. 1 by a drive motor that is not illustrated. In addition, the charge rollers 3*a* to 3*d* respectively cause the surfaces of each of the photoreceptor drums 2*a* to 2*d* to be uniformly charged to a predetermined electrical potential, by being rotationally driven by contacting each of the photoreceptor drums 2*a* to 2*d*.

The developing devices 4*a* to 4*d* are respectively disposed to oppose the photoreceptor drums 2*a* to 2*d*. The developing devices 4*a* to 4*d* respectively house magenta (M) toner, cyan (C) toner, yellow (Y) toner, and black (K) toner. Then, each of the developing devices 4*a* to 4*d* cause toner of each color to adhere to each electrostatic latent image formed on each of the photoreceptor drums 2*a* to 2*d* to create a visible image of each electrostatic latent image as toner images of each color.

In addition, the primary transfer rollers 5*a* to 5*d* are disposed to be able to abut each of the photoreceptor drums 2*a* to 2*d* in each primary transfer part via an intermediate transfer belt 7, which is an endless belt as a toner image carrier. Herein, the intermediate transfer belt 7 is stretched tightly between a drive roller 8 and two tension rollers 9. In addition, the intermediate transfer belt 7 is disposed on a top surface side of each of the photoreceptor drums 2*a* to 2*d*, and is made to able to travel on the top surface side of each photoreceptor drum 2*a* to 2*d*. The drive roller 8 is disposed to be able to abut a secondary transfer roller 10 in a secondary transfer portion via the intermediate transfer belt 7. In addition, a belt cleaning device 11 is disposed in the vicinity of the tension rollers 9. It should be noted that the details of the belt cleaning device 11 will be described later.

A laser scanner unit (LSU) 12 is disposed below all of the image forming units 1M, 1C, 1Y and 1K inside the apparatus main body 100. In addition, a paper feeding cassette 13 is installed in the base of the apparatus main body 100 below the LSU 12 to be removable from the apparatus main body 100. Furthermore, a plurality of sheets of paper, which is not illustrated, is housed in the paper feeding cassette 13 in a stacked state. Then, a pick-up roller 14 that picks up paper from the paper feeding cassette 13, a feed roller 15 that isolates a sheet of paper thus picked up and sends paper one-by-one to a conveying path S, and a retard roller 16 are disposed in the vicinity of this paper feeding cassette 13.

The conveying path S extends in the vertical direction in a side portion of the apparatus main body 100. A conveyance roller pair 17 that conveys paper, and a resist roller pair 18 that supplies this paper at a predetermined timing to the second transfer portion, which is an abutting portion between the drive roller 8 and the intermediate transfer belt 7, after the paper has been temporarily made to standby, are provided to this conveying path S. It should be noted that a separate conveying path S' used in a case of forming images on both sides of the paper is formed next to the conveying path S. A plurality of reverse rollers 19 is provided at appropriate intervals in this conveying path S'.

Furthermore, the conveying path S, which is disposed longitudinally, extends on one side inside of the apparatus main body 100 up to a catch tray 20 provided on a top surface of the apparatus main body 100. Then, a fusing device 21 and a discharge roller pair 22, 23 are disposed in the route of the conveying path S.

Next, image forming operations by a color laser printer having the above configuration will be explained.

When an image formation start signal is issued, each of the photoreceptor drums 2*a* to 2*d* in the respective image forming units 1M, 1C, 1Y and 1K are rotationally driven at a predetermined process speed in the arrow direction (clockwise direction) shown in FIG. 1. Then, these photoreceptor drums 2*a* to 2*d* are uniformly charged by the charge rollers 3*a* to 3*d*. In addition, the laser scanner unit 12 emits a laser beam modulated according to the color image signal of each color, and exposes the surface of each of the photoreceptor drums 2*a* to 2*d* to this laser beam. Electrostatic latent images corresponding to the color image signals of each color are thereby formed on each of the photoreceptor drums 2*a* to 2*d*, respectively.

Then, at first, magenta toner is adhered to the electrostatic latent image on the photoreceptor drum 2*a* of the magenta image forming unit 1M, by way of the developing device 4*a* in which developing bias of the same polarity as the charge polarity of the photoreceptor drum 2*a* has been applied. The electrostatic latent image is thereby created into a visible image as a magenta toner image. According to the action of the transfer roller 5*a* on which the primary transfer bias of a reverse polarity to the toner has been applied, this magenta toner image undergoes primary transfer in the primary transfer portion (transfer nip portion) between the photoreceptor drum 2*a* and the transfer roller 5*a* on the intermediate transfer belt 7 being rotationally driven in the arrow direction shown in FIG. 1.

The intermediate transfer belt 7 configured in the aforementioned way and on which the magenta toner image is primarily transferred moves to the subsequent cyan image forming unit 1C. Then, in the cyan image forming unit 1C as well, the cyan toner image formed on the photoreceptor drum 2*b*, similarly to as described, is transferred to overlap the magenta toner image on the intermediate transfer belt 7 in a first transfer portion.

By similarly performing the following, a yellow toner image and a black toner image formed on each of the photoreceptor drums 2*c* and 2*d* of the yellow image forming unit 1Y and the black image forming unit 1K, respectively, are sequentially superimposed in each first transfer portion on the magenta toner image and the cyan toner image overlappingly transferred onto the intermediate transfer belt 7. A full color toner image is thereby formed on the intermediate transfer belt 7. It should be noted that the transfer residue toner remaining on each of the photoreceptor drums 2*a* to 2*d* is removed using each of the drum cleaning devices 6*a* to 6*d* without being transferred to the intermediate transfer belt 7. Then, each of the photoreceptor drums 2*a* to 2*d* is ready for subsequent image formation.

Subsequently, at the timing at which a leading end of the full color toner image on the intermediate transfer belt 7 reaches a second transfer portion (transfer nip portion) between the intermediate transfer belt 7 and the secondary transfer roller 10, the paper sent to the conveying path S from the paper feeding cassette 13 by the pick-up roller 14, feed roller 15 and retard roller 16 is conveyed to the secondary transfer portion by the resist roller pair 18. Then, the full color toner image undergoes secondary transfer all together from the intermediate transfer belt 7 to the paper conveyed to the secondary transfer portion, by way of the secondary transfer roller 10 on which a secondary transfer bias of a reverse polarity to the toner has been applied.

The paper to which the full color toner image has been transferred is thereby conveyed to the fusing device 21. Then, the full color toner image transferred to the paper is heat fused to the surface of the paper by heating and pressing. The paper to which the toner image has been fused is discharged to the catch tray 20 by the discharge roller pair 22, 23. The sequence of image formation operations is thereby completed. It should be noted that the transfer residue toner remaining on the intermediate transfer belt 7 without being transferred onto the paper is removed by the belt cleaning device 11. Then, the intermediate transfer belt 7 is prepared for subsequent image formation.

Figure 3:
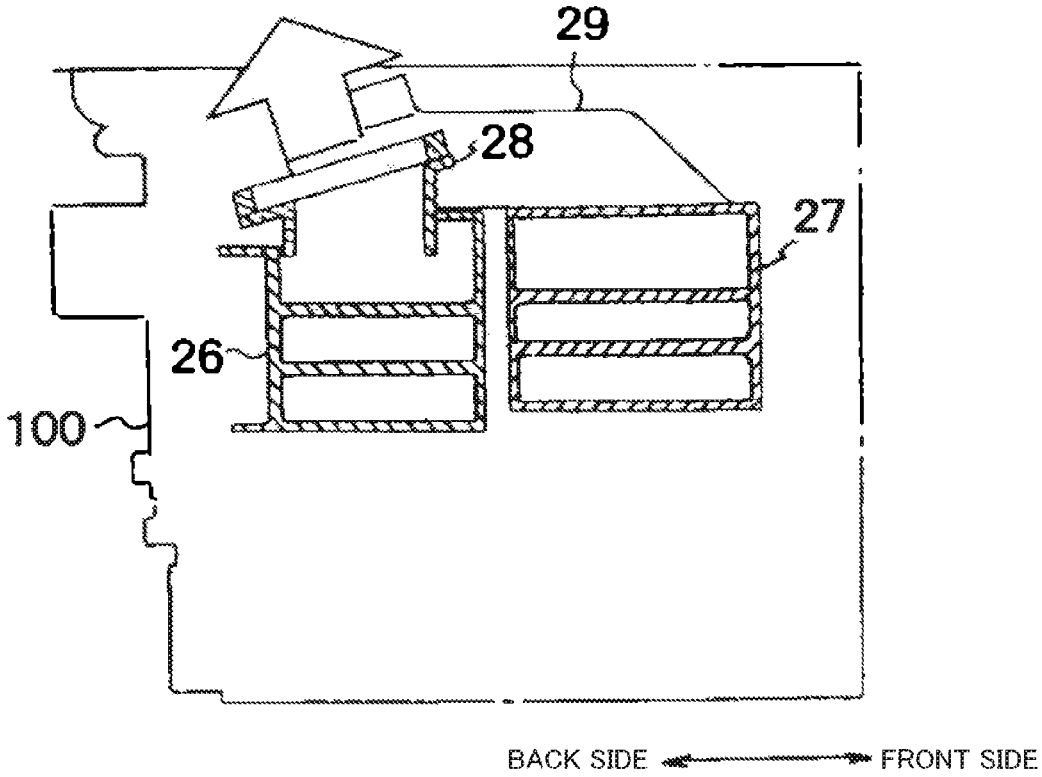
FIG. 3 is a cross-sectional view along the line A-A in FIG. 2.
Figure 4:
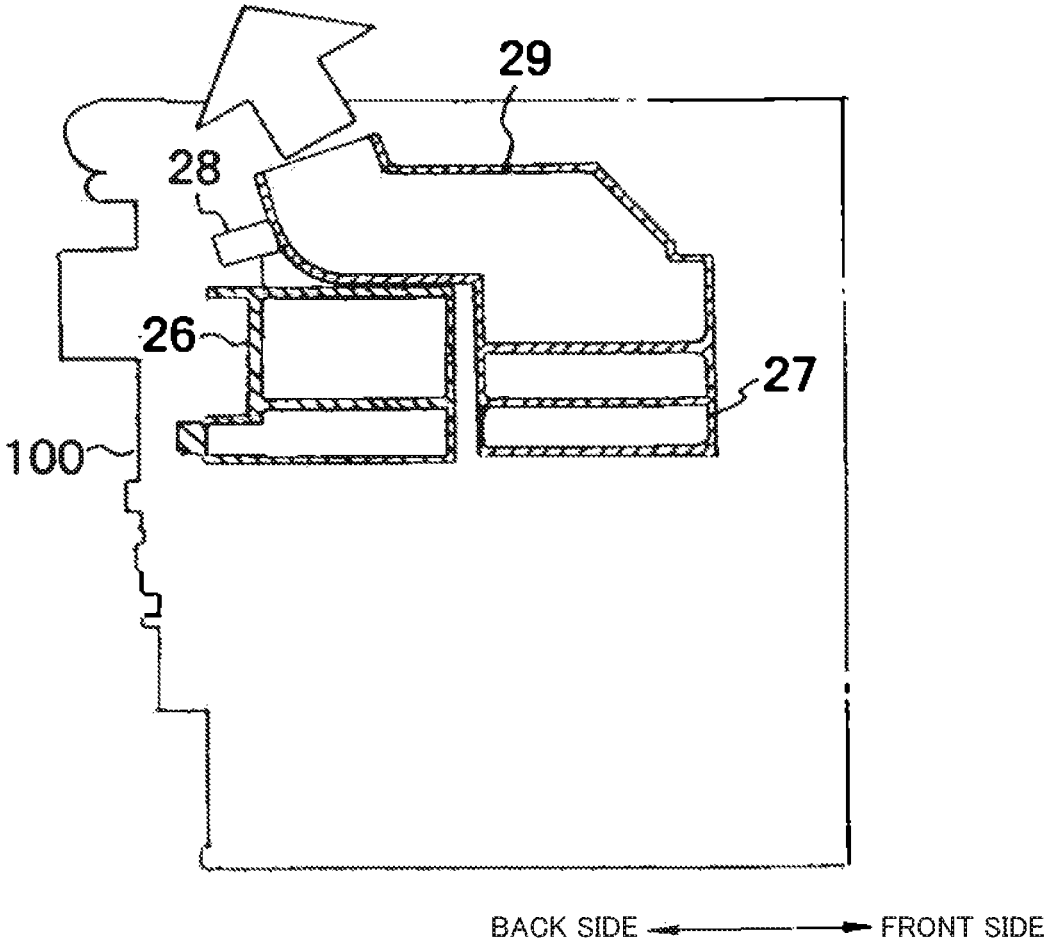
FIG. 4 is a cross-sectional view along the line B-B in FIG. 2.

Next, a cooling structure of a color laser printer according to the present embodiment will be explained while referring to FIGS. 2 to 4. It should be noted that FIG. 2 is a perspective view showing the cooling structure of the color laser printer, FIG. 3 is a cross-sectional view along the line A-A in FIG. 2, and FIG. 4 is a cross-sectional view along the line B-B in FIG. 2.

Figure 2:
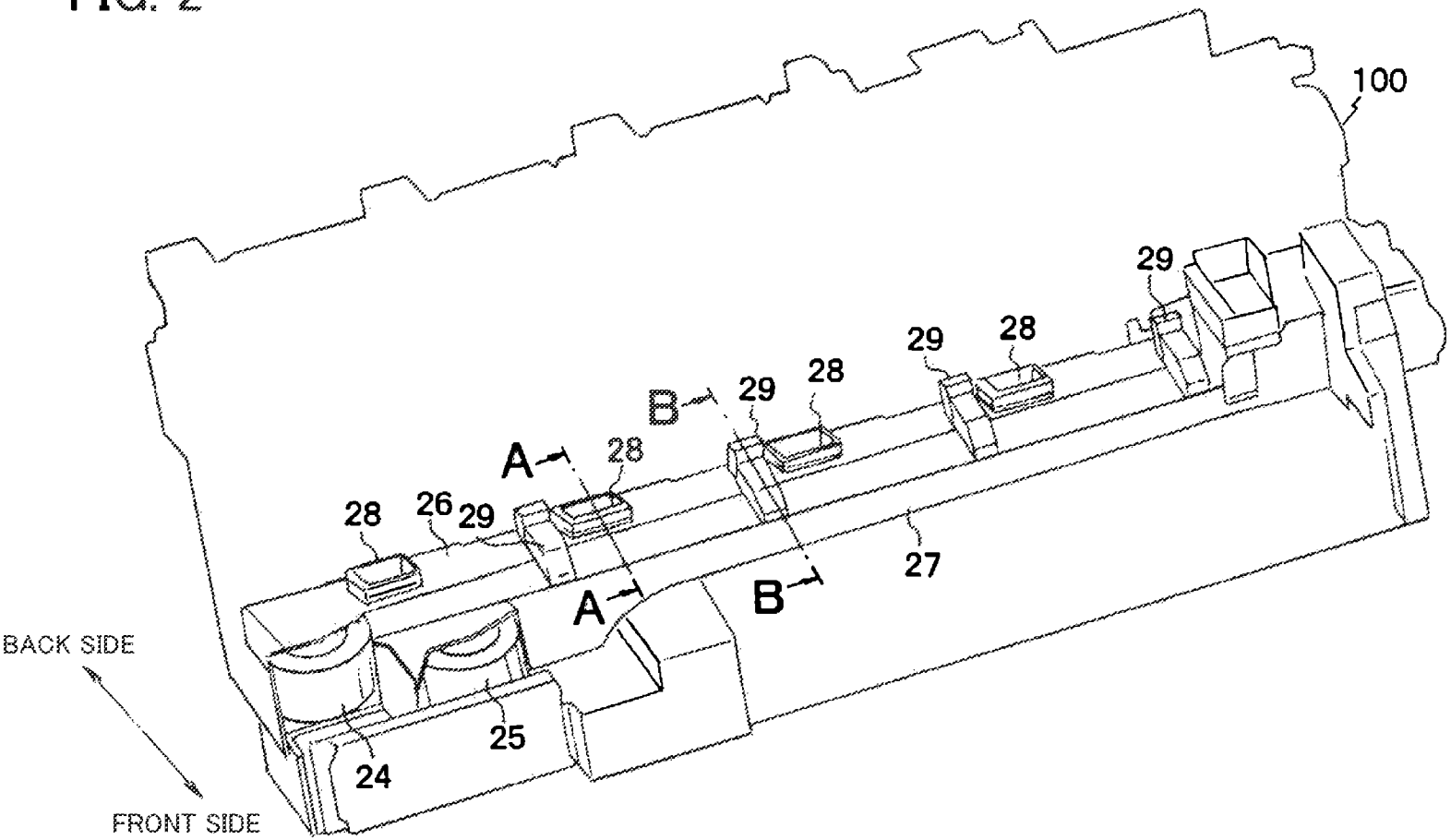
FIG. 2 is a perspective view showing a cooling structure of the image forming apparatus according to the present invention.

As shown in FIG. 2, cooling fans 24, 25 are respectively disposed at one side (left side) inside of the apparatus main body 100. In addition, an image-carrier cooling duct 27 and a developing-device cooling duct 26 are disposed to extend horizontally towards the other side (right side) from each of the cooling fans 24, 25, respectively. Herein, the developing device cooling duct 26 and the image-carrier cooling duct 27 flow cool air from the cooling fans 24 and 25 to developing devices 4*a* and 4*d* and the photoreceptor drums 2*a* to 2*d* of the image forming units 1M, 1C, 1Y and 1K, respectively, to individually cool these developing devices 4*a* and 4*d* and photoreceptor drums 2*a* to 2*d*, respectively. The developing-device cooling duct 26 is arranged horizontally in the left-right direction (traverse direction) at a back side inside of the apparatus main body 100, and the image-carrier cooling duct 27 is arranged horizontally and in parallel to the developing-device cooling duct 26 at a front side of this developing-device cooling duct 26.

Specifically, in the present embodiment, the developing-device cooling duct 26 and the image-carrier cooling duct 27 extending in the left-right direction are disposed abreast front to back (front side and back side) inside of the apparatus main body 100. Then, the insides of this developing-device cooling duct 26 and image-carrier cooling duct 27 are divided into same number of chambers as the number of developing devices 4*a* to 4*d* and photoreceptor drums 2*a* to 2*d*, as shown in FIGS. 3 and 4. Then, four nozzles 28 extending to each chamber lead out from an upper portion of the developing-device cooling duct 26 at appropriate intervals. Then, the four nozzles 28 open towards each of the developing devices 4*a* and 4*d* of the image forming units 1M, 1C, 1Y and 1K shown in FIG. 1 (refer to FIG. 3). In addition, four nozzles 29 extending to each chamber lead out from an upper portion of the image-carrier cooling duct 27 at appropriate intervals. Then, the four nozzles 29 open toward each of the photoreceptor drums 2*a* to 2*d* of the image forming units 1M, 1C, 1Y and 1K shown in FIG. 1 (refer to FIG. 4). Herein, the nozzles 29 provided to the image-carrier cooling duct 27 are disposed between the nozzles 28 provided to the developing-device cooling duct 26, and extend to be long toward the back side straddling the developing-device cooling duct 26. In addition, the number of respective chambers formed inside the developing-device cooling duct 26 and inside the image-carrier cooling duct 27, respectively, declines in the flow direction of the cool air as 4→3→2→1.

When the cooling fans 24, 25 are each rotationally driven, cool air induced by these cooling fans 24, 25 is thereby flowed inside the developing-device cooling duct 26 and inside the image-carrier cooling duct 27, respectively. Then, the cool air flowed inside of the developing-device cooling duct 26 cools each of the developing devices 4*a* to 4*d*, by blowing out toward the developing devices 4*a* to 4*d* of the image forming units 1M, 1C, 1Y and 1K from the four nozzles 28, respectively. In addition, the cool air flowed inside of the image-carrier cooling duct 27 cools each of the photoreceptor drums 2*a* to 2*d*, by blowing out towards the photoreceptor drums 2*a* to 2*d* of the image forming units 1M, 1C, 1Y and 1K from the four nozzles 29, respectively.

In the above way, the cooling ducts of the cooling structure of the color laser printer according to the present embodiment is configured from a developing-device cooling duct 26 and the image-carrier cooling duct 27, and this developing-device cooling duct 26 and image-carrier cooling duct 27 are disposed abreast at the front side and back side (front to back) inside of the apparatus main body 100. As a result of flowing cool air to each of the developing devices 4*a* to 4*d* and the photoreceptor drums 2*a* to 2*d* of the image forming units 1M, 1C, 1Y and 1K from the developing-device cooling duct 26 and the image-carrier cooling duct 27, it is possible to cool each of these, as well as being able to achieve a reduction in the size of the overall color laser printer by reducing the width and height of the apparatus main body 100.

It should be noted that a mode of applying the present invention to a color laser printer has been explained in the present embodiment. However, the present invention can be similarly applied also to any other color image forming apparatus such as a color photocopying machine, or to a monochrome image forming apparatus.

What is claimed is:

1. An image forming apparatus comprising inside an apparatus main body thereof:

a plurality of image carriers;

a plurality of developing devices disposed to oppose the plurality of image carriers;

a cooling fan; and a cooling duct flowing cool air from the cooling fan to at least the plurality of image carriers and the plurality of developing devices, wherein the cooling duct includes an image-carrier cooling duct that flows cool air to the plurality of image carriers; and a developing-device cooling duct that flows cool air to the plurality of developing devices, wherein the image-carrier cooling duct and the developing-device cooling duct are disposed abreast front to back inside of the apparatus main body, wherein a plurality of image carrier nozzles are provided to the image-carrier cooling duct and a plurality of developing device nozzles are provided to the developing-device cooling duct, respectively, wherein each of the plurality of image carrier nozzles opens toward each of the plurality of image carriers, wherein each of the plurality of developing device nozzles opens toward each of the plurality of developing devices, and wherein each of the plurality of image carrier nozzles is disposed between the developing device nozzles and straddles the developing-device cooling duct.

2. The image forming apparatus according to claim 1, wherein inside of the image-carrier cooling duct is divided into a same number of chambers as a number of the plurality of image carriers and inside of the developing-device cooling duct is divided into a same number of chambers as a number of the plurality of developing devices, respectively, and wherein cool air flowing in each of the chambers of the image-carrier cooling duct flows from each of the plurality of image carrier nozzles toward each of the plurality of image carriers, and cool air flowing in each of the chambers of the developing-device cooling duct flows from each of the plurality of developing device nozzles toward each of the plurality of developing devices, respectively.

3. The image forming apparatus according to claim 2, wherein the number of chambers formed inside of the image-carrier cooling duct and the number of chambers formed inside of the developing-device cooling duct decline with advancement along a flow direction of the cool air.

4. A cooling duct provided to an image forming apparatus equipped with a plurality of image carriers, a plurality of developing devices disposed to oppose the plurality of image carriers, and a cooling fan inside of an apparatus main body thereof, the cooling duct comprising:

an image-carrier cooling duct that flows cool air from the cooling fan toward the plurality of image carriers; and a developing-device cooling duct that flows cool air from the cooling fan toward the plurality of developing devices, wherein the image-carrier cooling duct and the developing-device cooling duct are disposed abreast front to back inside of the apparatus main body, wherein a plurality of image carrier nozzles are provided to the image-carrier cooling duct and a plurality of developing device nozzles are provided to the developing-device cooling duct, respectively, wherein each of the plurality of image carrier nozzles opens toward each of the plurality of image carriers, wherein each of the plurality of developing device nozzles opens toward each of the plurality of developing devices, and wherein each of the plurality of image carrier nozzles is disposed between the developing device nozzles and straddles the developing-device cooling duct.

5. The cooling duct according to claim 4, wherein inside of the image-carrier cooling duct is divided into a same number of chambers as a number of the plurality of image carriers and inside of the developing-device cooling duct is divided into a same number of chambers as a number of the plurality of developing devices, respectively, and wherein cool air flowing in each of the chambers of the image-carrier cooling duct flows from each of the plurality of image carrier nozzles towards each of the plurality of image carriers, and cool air flowing in each of the chambers of the developing-device cooling duct flows from each of the plurality of developing device nozzles towards each of the plurality of developing devices, respectively.

6. The cooling duct according to claim 5, wherein the number of chambers formed inside of the image-carrier cooling duct and the number of chambers formed inside of the developing-device cooling duct decline with advancement along a flow direction of the cool air.

* * * * *